US005581904A

United States Patent [19]

Ewen

[11] Patent Number: 5,581,904

[45] Date of Patent: Dec. 10, 1996

[54] CENTRIFUGAL DRYER

[75] Inventor: Philip Ewen, Paddington, Australia

[73] Assignee: Freshpac Machinery Pty. Ltd., New South Wales, Australia

[21] Appl. No.: 295,434

[22] Filed: Aug. 25, 1994

[30] Foreign Application Priority Data

Aug. 26, 1993 [AU] Australia ..... PM0861

[51] Int. Cl.[6] ..... F26B 5/08

[52] U.S. Cl. ..... 34/319; 34/322; 34/328; 210/770

[58] Field of Search ..... 34/312, 318, 319, 34/322, 328, 313, 58, 59, 126; 210/369, 380.1, 380.3, 770

[56] References Cited

U.S. PATENT DOCUMENTS

| | | | |
|---|---|---|---|
| 11,458 | 8/1854 | Black | 34/322 |
| 1,212,831 | 1/1917 | Spelman | 210/360.1 |
| 2,787,841 | 4/1957 | Warino | 34/58 |
| 3,152,078 | 10/1964 | Lavanchy | 210/360.1 |
| 3,275,142 | 9/1966 | Ekegren et al. | 34/313 |

FOREIGN PATENT DOCUMENTS

| | | | |
|---|---|---|---|
| 28729 | 8/1912 | United Kingdom | 210/380 |

*Primary Examiner*—Henry A. Bennett
*Assistant Examiner*—Susanne C. Tinker
*Attorney, Agent, or Firm*—Collier, Shannon, Rill & Scott, PLLC

[57] ABSTRACT

A method and apparatus for drying particulate matter such as vegetables and the like is disclosed. The apparatus has a centrifugal dryer that includes a drum adapted to be rotated about its longitudinal axis which is canted with respect to the vertical. The drum is open at its upper end to receive the particulate matter, the lower end of the drum includes a lower opening to facilitate dispensing of the particulate matter after it has been dried. The drum includes a perforate wall and a radially inwardly extending annular member which preferably extends from the lower end of the perforate wall. In use, the drum is rotated at a low speed whilst the particulate matter is introduced, the drum then being accelerated through the drying cycle and decelerated again for dispensing through the lower opening. In the preferred form the dryers are used in coupled pairs which allows for effectively continuous processing, despite the batch type operation of the individual dryers.

6 Claims, 3 Drawing Sheets

CENTRIFUGAL DRYER

BACKGROUND OF THE INVENTION

1. Field of the Invention

The present invention relates to a centrifugal dryer including a rotatably mounted drum. Specifically, the invention is a centrifugal dryer for use in drying cut farm produce such as vegetables.

2. Description of the Background Art

The use of centrifuges to extract liquid is well known. In the field of vegetable processing, rotatably mounted drums having perforate walls have been used to centrifugally dry vegetables prior to packing. Such known devices have generally been ergonomically inefficient in terms of filling and emptying.

The background art includes a perforate open-ended cylinder adapted to be rotated about its longitudinal axis. Also mounted for rotation with the cylinder is a circular disk disposed intermediate to the ends of the cylinder in a plane normal to the axis of the cylinder such that an annular gap is defined between the periphery of the disk and the cylinder's inner wall. In use, the cylinder axis is oriented vertically and produce is gravity fed through the upper open end of the rotating cylinder and strikes the rotating circular disk. Due to the rotation of the disk the produce is centrifugally thrown outwardly where it impinges the wall of the cylinder and excess water is centrifugally drained through the perforations in the cylinder wall. The cylinder is then decelerated and produce falls through the annular gap and is dispensed through the lower open end of the cylinder. This dispensing can be assisted by blasting air into the cylinder. Whilst this arrangement goes some way towards addressing the problems of filling and emptying centrifugal dryers, it has been found to be impractical.

It is an object of the invention to overcome or at least ameliorate one or more of these deficiencies of the prior art.

SUMMARY OF THE INVENTION

According to a first aspect of the invention there is provided a centrifugal dryer including a drum adapted to be rotated about its longitudinal axis canted with respect to the vertical, the drum being open at each end and including a perforate wall and a radially inwardly extending annular member integral with a lower end of the perforate wall.

Preferably, the inner periphery of the annular surface defines the opening at the lower end of the drum.

Desirably, the perforate wall is generally cylindrical.

In the preferred form, the radially inwardly extending annular surface is generally frusto conical in shape tapering toward the longitudinal axis from the perforate wall to the opening at the lower end of the drum.

According to a second aspect of the invention there is provided a method of drying particulate matter. The method includes rotating a drum at low speed about its longitudinal axis canted with respect to the vertical, the drum being open at each end and including a perforate wall and a generally radially inwardly extending annular member integral with a lower end of the perforate wall. The method then involves introducing particulate matter into the drum such that the particulate matter is initially arrested by the annular member and thereafter, subsequently introduced particulate matter is arrested by particulate matter already present in the drum. Accelerating the drum to effect centrifugal drying of the particulate matter and decelerating the drum so as to dispense the particulate matter through the opening in its lower end is then performed.

Preferably, the dispensing of the particulate matter is assisted by the introduction of a gas to the drum.

Specifically, the invention is a centrifugal dryer for use in drying cut farm produce such as vegetables and will be described hereinafter with reference to this application. However, it will be appreciated that the invention is not limited to this particular field of use and can be used to dry any particulate matter capable of being conveyed or poured into the drum.

BRIEF DESCRIPTION OF THE DRAWINGS

A preferred embodiment of the invention will now be described, by way of example only, with reference to the accompanying drawings in which.

DETAILED DESCRIPTION OF THE INVENTION

Figure 1:
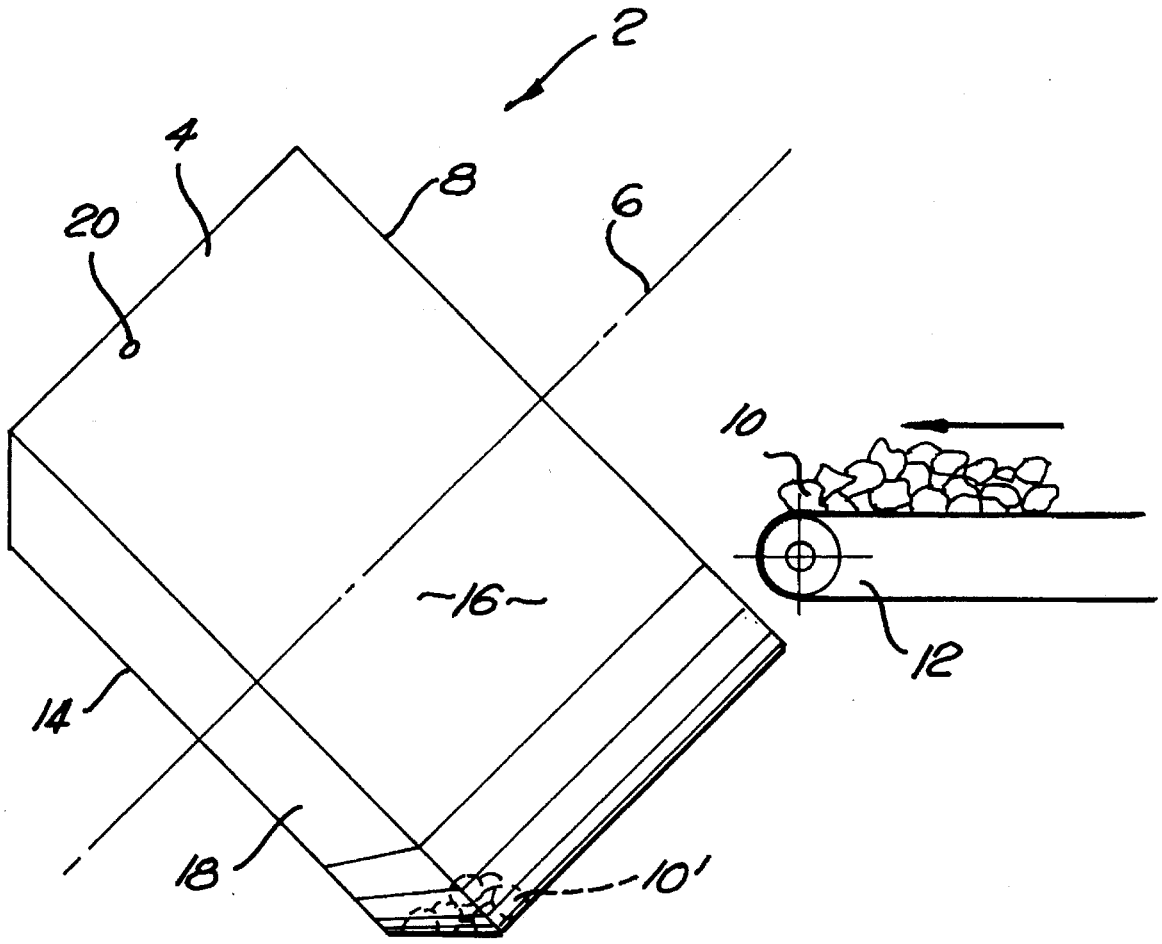
FIG. 1 is a schematic elevational view of a centrifugal dryer according to the invention.

FIG. 1 illustrates a centrifugal dryer 2 including a drum 4 adapted to be rotated about its longitudinal axis 6 canted with respect to the vertical or "vertically canted." The drum 4 is open at its upper end 8 to receive particulate matter 10, such as vegetables, transported by feed conveyor 12. The lower end of drum 4 includes a lower opening 14 to facilitate dispensing of the particulate matter after it has been dried.

The drum 4 includes a perforate wall 16 and a radially inwardly extending generally frusto conical annular member 18 which is secured with or optionally integrally formed with the lower end of perforate wall 16. For the purposes of simplicity, only one perforation 20 is illustrated. As will be appreciated by those skilled in the art, a large number of perforations 20 can be provided.

In use, the drum 4 is rotated at a low speed whilst particulate matter in the form of cut vegetables 10 is introduced into the drum by feed conveyor 12. In the presently preferred embodiment, a rotational speed of 100 rpm has been experimentally found to be suitable. The low speed must be sufficient to generate a centrifugal force sufficient to retain the vegetables in the drum.

When cut vegetables are initially introduced into the empty drum 4, the cut vegetables slide in a helical path with respect to the perforate wall 16 to the bottom of the drum due to a combination of gravity and the rotation of the drum 4. When the cut vegetables reach the lower end of the drum the cut vegetables are arrested by the annular member 18. It has been found through trial that where the vegetables are diced, such as carrots or capsicum, a small amount of produce initially bounces through lower opening 14 without being arrested. However, particulate matter 10, which is arrested against annular member 18 is retained in this position by the centrifugal force generated by the rotation of the drum 4.

As further particulate matter 10 is introduced into drum 4, it slides down the drum 4 until it is arrested by the particulate matter 10', which is already present in the drum 4 and is retained against the inner wall by the centrifugal force. It will thus be appreciated that particulate matter 10' builds up in a spiral or helix manner until it fully coats the inner wall of the drum 4. At this point feed conveyor 12 is stopped or reversed and the drum 4 is accelerated to dry the particulate matter 10' or cut vegetables in the normal manner. In the preferred embodiment the drum 4 is accelerated to about 960 rpm.

Once the drying cycle is complete, the drum 4 is decelerated and the dried cut vegetables are allowed to fall through lower opening 14 by gravity. In the preferred embodiment the drum 4 is decelerated to 20 rpm at which speed the centrifugal force is insufficient to maintain the particulate matter 10' or cut vegetables in the drum 4. Hence, the dried vegetables tend to collapse towards the lowest point of the drum at which point they are "screwed" out of the drum 4 in a manner similar to a cement mixer. As will be appreciated by those skilled in the art, the dried vegetables tend to adhere to the inner wall of the drum 4 d thus dispensing of the dried matter can be assisted by the optional introduction of a blast of air or other suitable generally dry gas.

Figure 2:
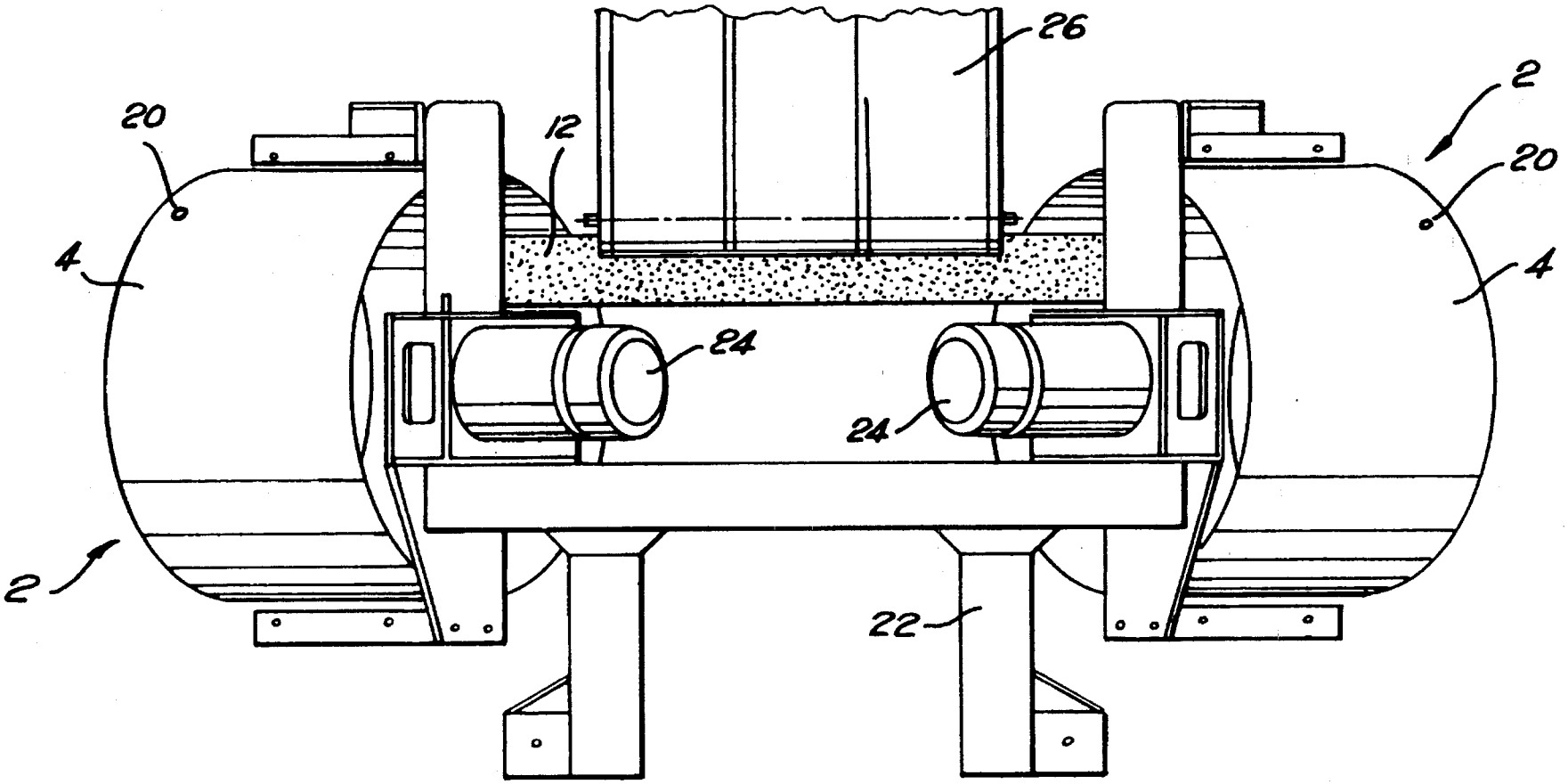
FIG. 2 is a top plan view of a drying system incorporating a pair of centrifugal dryers according to the invention.

FIG. 2 illustrates a drying system incorporating a pair of centrifugal dryers 2 of the type described above. The drums 4 are respectively rotatably mounted in frame 22 which is of a robust construction to resist any eccentric loading of the drums. Moreover, frame 22 is used to mount electric motors 24 which rotatably drive their respective drums 4. In this embodiment, feed conveyor 12 is continuously fed by a second conveyor 26. The second conveyor 26 is a shaker or vibrating conveyor which evenly distributes the cut vegetables and facilitates uniform feeding to feed conveyor 12.

The feed conveyor 12 can be driven to supply particulate matter 10 to one drum 4 and then reversed to supply particulate matter 10 to the second drum 4 whilst the first drum 4 goes through its drying and dispensing cycles. It will thus be appreciated that the combination of a pair of centrifugal dryers provides a system which is effectively continuously "on-line" despite the batch processing nature of each individual centrifugal dryer.

Figure 3:
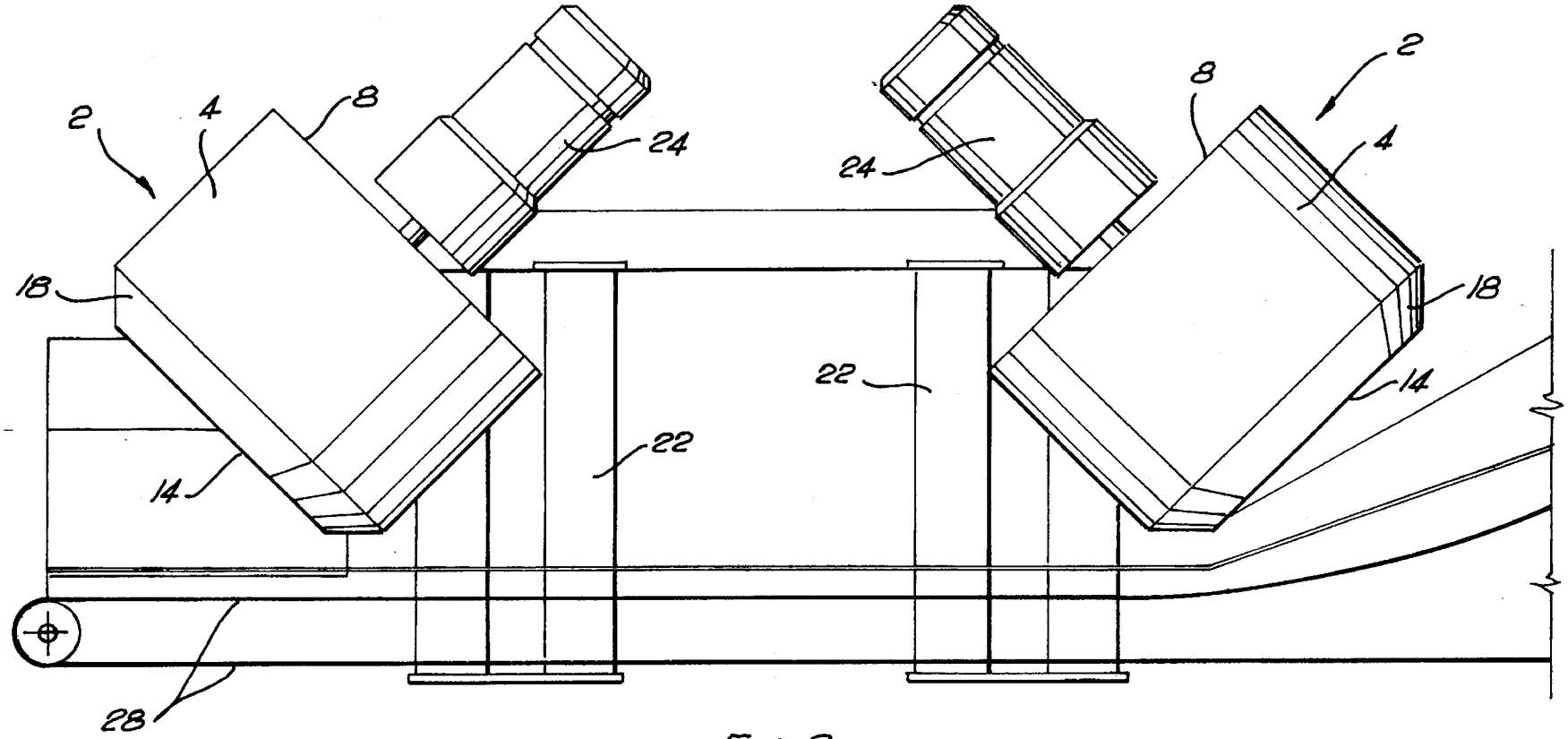
FIG. 3 is an elevational view of the drying system of FIG. 2 with details of the feeding conveyors omitted.

FIG. 3, in which a number of details have been omitted for the purposes of clarity, illustrates a third outfeed conveyor 28 disposed under lower openings 14 to collect dried vegetables after they have been dispensed from either of the respective drums 4. The outfeed conveyor 28 leads to the next processing step which is usually packaging.

This system lends itself to a modular construction wherein a plurality of pairs of drums can be juxtaposed and serviced by a single outfeed conveyor 28.

In addition to the efficiency of filling and emptying conferred by the present invention, it has also been found that, because canting the drum effectively lowers its center of gravity, the present invention is more stable when eccentrically loaded than an upright drum of the same dimensions.

Although the invention has been described with reference to specific embodiments, it will be appreciated by those skilled in the art that the invention may be embodied in many other forms.

I claim:

1. A method of drying particulate matter comprising the steps off rotating a drum at low speed about its longitudinal axis canted with respect to the vertical, said drum being open at each end and including a perforate wall and a generally radially inwardly extending annular member integral with a lower end of said perforate wall;

introducing particulate matter into said drum whereby said particulate matter is initially arrested by said annular member and thereafter, subsequently introduced particulate matter is arrested by particulate matter already present in said drum;

accelerating said drum to effect centrifugal drying of said particulate matter; and decelerating said drum and dispensing said dried particulate matter through said lower end.

2. A method of drying particulate matter according to claim 1, further comprising the step of introducing a gas into said drum to assist in dispensing of said particulate matter therefrom.

3. A method of drying particulate matter according to claim 1, wherein said particulate matter is introduced into said drum via a conveyor.

4. A method of drying particulate matter according to claim 1, wherein a plurality of drums are fed by a single conveyor or set of conveyors.

5. A method of drying particulate matter according to claim 1, wherein said drums are controlled by electric motors.

6. A method of drying particulate matter according to claim 1, wherein a plurality of rotating drums are employed with staggered spinning cycles such that a continuous output of dried particulate matter is yielded.

* * * * *